US010810935B2

(12) United States Patent
Yamanaka

(10) Patent No.: US 10,810,935 B2
(45) Date of Patent: Oct. 20, 2020

(54) ORGANIC ELECTROLUMINESCENCE DISPLAY DEVICE AND DRIVING METHOD THEREOF

(71) Applicant: Sharp Kabushiki Kaisha, Sakai, Osaka (JP)

(72) Inventor: Shigetsugu Yamanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 291 days.

(21) Appl. No.: 16/066,067

(22) PCT Filed: Mar. 15, 2017

(86) PCT No.: PCT/JP2017/010468
§ 371 (c)(1),
(2) Date: Jun. 26, 2018

(87) PCT Pub. No.: WO2018/167884
PCT Pub. Date: Sep. 20, 2018

(65) Prior Publication Data

US 2020/0265781 A1 Aug. 20, 2020

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01)

(58) Field of Classification Search
None
See application file for complete search history.

(56) References Cited

U.S. PATENT DOCUMENTS

2005/0057193 A1 3/2005 Ono et al.
2006/0284802 A1 12/2006 Kohno
(Continued)

FOREIGN PATENT DOCUMENTS

JP 2005-70614 A 3/2005
JP 2005-242162 A 9/2005
(Continued)

OTHER PUBLICATIONS

Official Communication issued in International Patent Application No. PCT/JP2017/010468, dated May 30, 2017.

*Primary Examiner* — Stephen T. Reed
(74) *Attorney, Agent, or Firm* — Keating & Bennett, LLP

(57) ABSTRACT

Image data having parts that change in sine wave shape or cosine wave shape in the horizontal direction and the vertical direction is used as current measurement patterns. A current measuring unit measures current flowing in a power source line from all of organic EL elements included in a display unit. A current distribution pattern generating unit generates a current distribution pattern by performing a two-dimensional inverse discrete Fourier transform on a plurality of current values measured when the current measurement patterns are displayed in order. An image signal correcting unit corrects an image signal on the basis of the current distribution pattern and a cumulative added value of an image signal. Accordingly, the extent of performance degradation of the organic EL elements is estimated, and uneven brightness in the display screen is prevented.

9 Claims, 3 Drawing Sheets

(56) References Cited

U.S. PATENT DOCUMENTS

| | | | | |
|---|---|---|---|---|
| 2007/0103411 | A1 | 5/2007 | Cok et al. | |
| 2017/0193920 | A1* | 7/2017 | Kim | G09G 3/3291 |
| 2017/0243539 | A1* | 8/2017 | Li | G09G 3/3233 |

FOREIGN PATENT DOCUMENTS

| | | | |
|---|---|---|---|
| JP | 2006-349966 | A | 12/2006 |
| JP | 2009-515219 | A | 4/2009 |
| JP | 2011-53634 | A | 3/2011 |

* cited by examiner

ORGANIC ELECTROLUMINESCENCE DISPLAY DEVICE AND DRIVING METHOD THEREOF

TECHNICAL FIELD

The disclosure relates to a display device, and particularly an organic electroluminescence display device.

BACKGROUND ART

Organic EL display devices including pixel circuits including organic Electro Luminescence (called "EL" hereinafter) elements have recently been coming into practical use. Organic Light Emitting Diodes (OLEDs), for example, are used for organic EL elements. An organic EL element emits brighter light the greater the current flowing in the element, but also degrades faster. Thus, the performance of individual organic EL elements degrades in accordance with a cumulative brightness. Accordingly, uneven brightness can arise in screens displayed in an organic EL display device unless a correction process that compensates for degradation in the performance of the organic EL elements is carried out.

Various types of methods have been proposed in the related art as methods for preventing uneven brightness. For example, a method of measuring current flowing in an organic EL element and correcting an image signal on the basis of the measurement result is known. A method is also known in which image signals are cumulatively added, the extent of degradation in the performance of organic EL elements is estimated, and image signals are corrected on the basis of the estimation result. PTL 1 discloses a display device that detects trends in the unevenness of the brightness of a display unit.

CITATION LIST

Patent Literature

PTL 1: JP 2011-53634 A

SUMMARY

Technical Problem

To effectively prevent uneven brightness, it is preferable that current flowing in organic EL elements be measured individually not only in an inspection process before the product is shipped, but during normal operation as well. In reality, however, it is difficult to individually measure current flowing in organic EL elements. For example, in a case where many current measuring instruments are provided corresponding to the data lines in order to take measurements in a short amount of time, variations in the accuracy at which the current measuring instruments take measurements can lead to decreases in the current measurement accuracy, longer times for reading out measurement results, and the like. When individually measuring current flowing in organic EL elements using a scanning method, in a case where dead lines or dead spots arise, it is difficult to measure the current in multiple normal adjacent regions in the periphery of those dead lines or dead spots.

As such, an object of the disclosure is to provide an organic EL display device capable of preventing uneven brightness in a display screen by estimating the extent of degradation in the performance of organic EL elements using a different approach from that used in the related art.

Solution to Problem

A first aspect of the disclosure is an organic electroluminescence display device including:

a display unit including a plurality of scanning lines, a plurality of data lines, a power source line, and a plurality of pixel circuits, each of the plurality of pixel circuits including an organic electroluminescence element;

a driving circuit configured to drive the plurality of scanning lines and the plurality of data lines;

a current measuring unit configured to measure current flowing in the power source line from a plurality of the organic electroluminescence elements;

a current distribution pattern generating unit configured to generate a current distribution pattern, based on a plurality of current values measured by the current measuring unit in a case that a plurality of current measurement patterns that are predetermined are displayed in order; and an image signal correcting unit configured to correct an image signal, based on the current distribution pattern, wherein the plurality of current measurement patterns are image data, the image data including parts that change periodically in a horizontal direction and a vertical direction; and the current distribution pattern generating unit is configured to generate the current distribution pattern by carrying out operations on the plurality of current values in accordance with periodic changes in the plurality of current measurement patterns.

A second aspect of the disclosure is the first aspect of the disclosure, wherein the plurality of current measurement patterns include image data, the image data including parts that change in sine wave shape or cosine wave shape in the horizontal direction and the vertical direction; and the current distribution pattern generating unit is configured to generate the current distribution pattern by performing a two-dimensional inverse discrete Fourier transform on the plurality of current values.

A third aspect of the disclosure is the second aspect of the disclosure, wherein the plurality of current measurement patterns are image data, the image data as a whole changing in sine wave shape or cosine wave shape in the horizontal direction and the vertical direction.

A fourth aspect of the disclosure is the third aspect of the disclosure, wherein the plurality of current measurement patterns include image data that as a whole changes in sine wave shape N or fewer times in the horizontal direction and M or fewer times in the vertical direction, and image data that as a whole changes in cosine wave shape N or fewer times in the horizontal direction and M or fewer times in the vertical direction, where N and M are integers greater than or equal to 1.

A fifth aspect of the disclosure is the second aspect of the disclosure, wherein the plurality of current measurement patterns are image data, parts of the image data changing in sine wave shape or cosine wave shape in the horizontal direction and the vertical direction.

A sixth aspect of the disclosure is the fifth aspect of the disclosure, wherein the plurality of current measurement patterns include image data in which parts change in sine wave shape N or fewer times in the horizontal direction and M or fewer times in the vertical direction, and image data in which parts change in cosine wave shape N or fewer times in the horizontal direction and M or fewer times in the vertical direction, where N and M are integers greater than or equal to 1.

A seventh aspect of the disclosure is the first aspect of the disclosure, wherein the current measuring unit is provided between the power source line and a ground.

An eighth aspect of the disclosure is the seventh aspect of the disclosure, wherein the power source line is connected to a cathode terminal of all of the organic electroluminescence elements included in the display unit.

A ninth aspect of the disclosure is the first aspect of the disclosure, wherein the current measuring unit is configured to measure current flowing in the power source line from a cathode terminal common to a plurality of the organic electroluminescence elements; and the image signal correcting unit is configured to correct the image signal, based on a current distribution pattern generated based on a plurality of current values measured by the current measuring unit.

A tenth aspect of the disclosure is the ninth aspect of the disclosure, wherein the current measuring unit is configured to measure current flowing in the power source line from a cathode terminal common to all of the plurality of organic electroluminescence elements included in the display unit.

An eleventh aspect of the disclosure is the first aspect of the disclosure, further including:

an image signal cumulating unit configured to find a cumulative added value of the image signal, wherein the image signal correcting unit is configured to correct the image signal, based on the current distribution pattern and the cumulative added value.

A twelfth aspect of the disclosure is a method of driving an organic electroluminescence display device, the device including a display unit including a plurality of scanning lines, a plurality of data lines, a power source line, and a plurality of pixels circuits, each of the plurality of pixel circuits including an organic electroluminescence element, and the method including:

driving the plurality of scanning lines and the plurality of data lines;

measuring current flowing in the power source line from a plurality of the organic electroluminescence elements;

generating a current distribution pattern, based on a plurality of current values measured in a case that a plurality of current measurement patterns that are predetermined are displayed in order; and correcting an image signal, based on the current distribution pattern, wherein the plurality of current measurement patterns are image data, the image data including parts that change periodically in a horizontal direction and a vertical direction; and in the generating a current distribution pattern, the current distribution pattern is generated by carrying out operations on the plurality of current values in accordance with periodic changes in the plurality of current measurement patterns.

Advantageous Effects of Disclosure

According to the above-described first or twelfth aspect, the current distribution pattern indicating the extent of performance degradation in the organic EL elements is generated by measuring the current flowing in the power source line from the plurality of organic EL elements when the current measurement patterns are displayed in order and carrying out operations on the plurality of current values. The image signal is corrected using the generated current distribution pattern. Accordingly, the extent of performance degradation in the organic EL elements can be estimated, and uneven brightness in the display screen can be prevented, without individually measuring the currents flowing in the organic EL elements.

According to the above-described second aspect, current measurement patterns having parts that change in sine wave shape or cosine wave shape in the horizontal direction and the vertical direction are used, and the current distribution pattern is generated by performing a two-dimensional inverse discrete Fourier transform on the plurality of current values. Accordingly, a current distribution pattern that expresses the extent of performance degradation in the organic EL elements well can be generated, and the same effects as those of the above-described first aspect can be achieved.

According to the above-described third or fourth aspect, the same effects as those of the above-described first aspect can be achieved by using current measurement patterns that as a whole change in sine wave shape or cosine wave shape in the horizontal direction and the vertical direction.

According to the above-described fifth or sixth aspect, the same effects as those of the above-described first aspect can be achieved by using current measurement patterns in which parts change in sine wave shape or cosine wave shape in the horizontal direction and the vertical direction.

According to the above-described seventh aspect, the current flowing in the power source line from the plurality of organic EL elements can be measured using a current measuring unit provided between the power source line and the ground.

According to the above-described eighth or tenth aspect, the current flowing in the power source line from all of the organic EL elements included in the display unit is measured using a current measuring unit provided between the power source line connected to the cathode terminals of all of the organic EL elements included in the display unit, and the ground. This makes it possible to prevent a drop in the accuracy of the current measurement caused by variations in the measurement accuracies of the current measuring instruments.

According to the above-described ninth aspect, the same effects as those of the above-described first aspect can be achieved by measuring the current flowing in the power source line from a cathode terminal common to the plurality of organic electroluminescence elements.

According to the above-described eleventh aspect, the image signal is corrected taking into account the cumulative added value of the image signal, and thus uneven brightness in the display screen can be more effectively suppressed.

DESCRIPTION OF EMBODIMENTS

Figure 1:
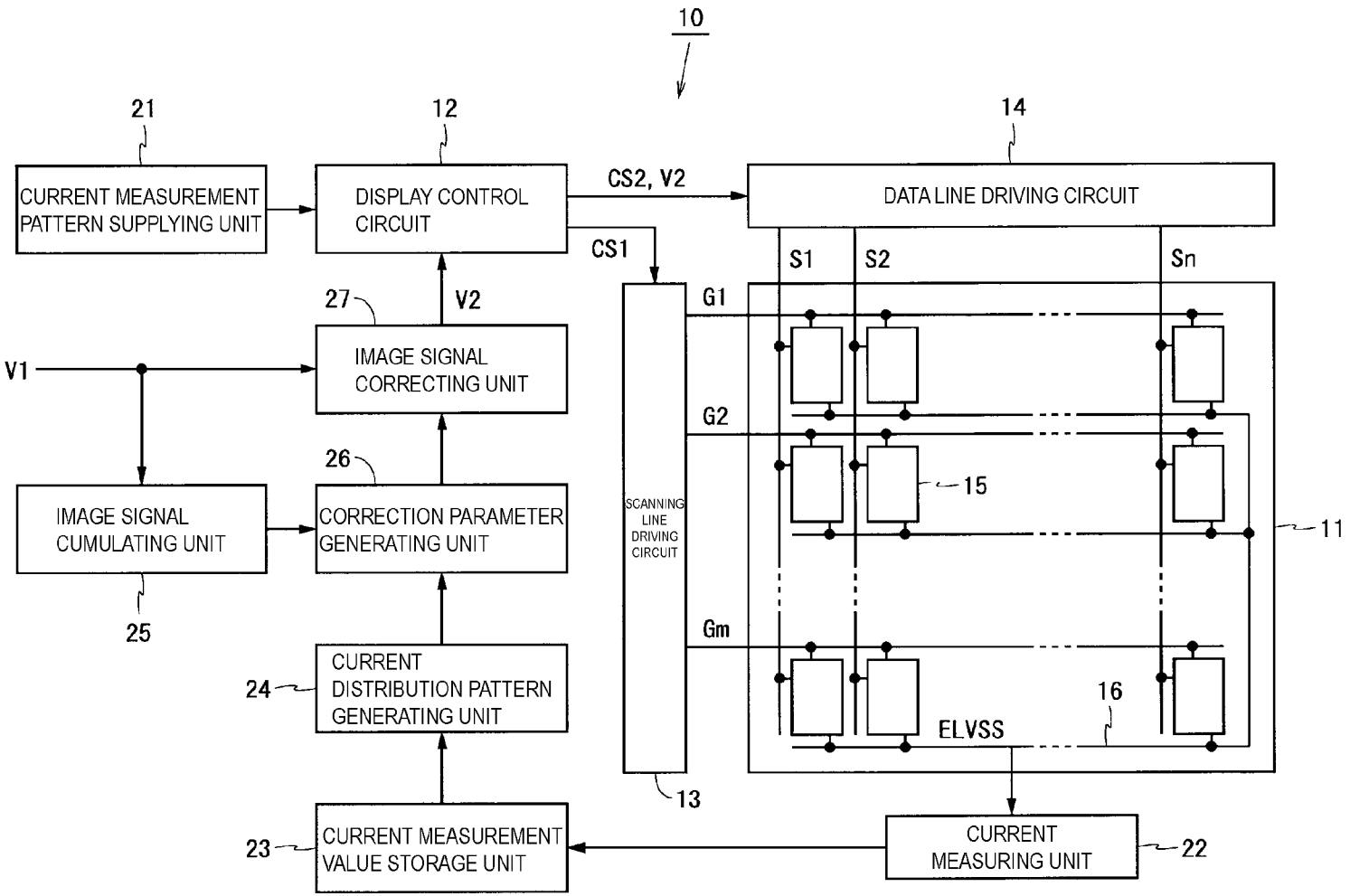
FIG. 1 is a block diagram illustrating the configuration of an organic EL display device according to embodiments of the disclosure.

FIG. 1 is a block diagram illustrating the configuration of an organic EL display device according to embodiments of the disclosure. An organic EL display device 10 illustrated in FIG. 1 includes a display unit 11, a display control circuit 12, a scanning line driving circuit 13, a data line driving circuit 14, a current measurement pattern supplying unit 21, a current measuring unit 22, a current measurement value storage unit 23, a current distribution pattern generating unit 24, an image signal cumulating unit 25, a correction parameter generating unit 26, and an image signal correcting unit 27. In the following, m represents an integer greater than or equal to 1, n represents a multiple of 3, i represents an integer greater than or equal to 1 and less than or equal to m, and j represents an integer greater than or equal to 1 and less than or equal to n. The value of n is determined in accordance with the type of color of light emitted by an organic EL element. As such, n is not limited to a multiple of 3, and may be determined to be a multiple of 2, a multiple of 4, or the like.

The display unit 11 includes m scanning lines G1 to Gm, n data lines S1 to Sn, and (n×m) pixel circuits 15. The scanning lines G1 to Gm are arranged parallel to each other. The data lines S1 to Sn are arranged orthogonal to the scanning lines G1 to Gm and parallel to each other. The scanning lines G1 to Gm and the data lines S1 to Sn intersect at (n×m) locations. One of the (n×m) pixel circuits 15 is arranged corresponding to each intersection point between the scanning lines G1 to Gm and the data lines S1 to Sn. A high-level power source voltage ELVDD is supplied to the pixel circuits 15 using power source lines (not illustrated), and a low-level power source voltage ELVSS is supplied to the pixel circuits 15 using a power source line 16.

Figure 2:
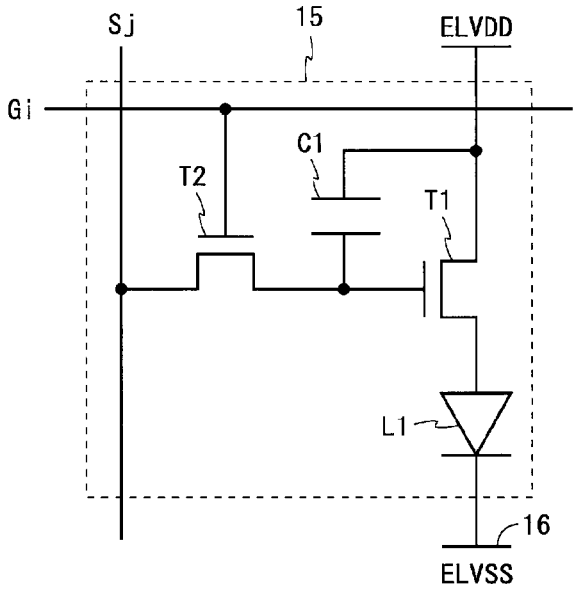
FIG. 2 is a circuit diagram illustrating a pixel circuit of the organic EL display device illustrated in FIG. 1.

FIG. 2 is a circuit diagram illustrating the pixel circuit 15. FIG. 2 illustrates a pixel circuit 15 in an ith row and a jth column. The pixel circuit 15 includes transistors T1 and T2, an organic EL element L1, and a capacitor C1, and is connected to a scanning line Gi and a data line Sj. The transistors T1 and T2 are n-channel thin film transistors.

The high-level power source voltage ELVDD is applied to a drain terminal of the transistor T1. A source terminal of the transistor T1 is connected to an anode terminal of the organic EL element L1. A cathode terminal of the organic EL element L1 is connected to the power source line 16. The low-level power source voltage ELVSS is applied to the cathode terminal of the organic EL element L1. One conduction terminal of the transistor T2 (the terminal on the left side in FIG. 2) is connected to the data line Sj. The other conduction terminal of the transistor T2 is connected to a gate terminal of the transistor T1. A gate terminal of the transistor T2 is connected to the scanning line Gi. The capacitor C1 is provided between the gate terminal and the drain terminal of the transistor T1. The power source line 16 is connected to the cathode terminals of all of the organic EL elements L1 included in the display unit 11.

The organic EL display device 10 has a normal operating mode and a performance detecting mode. In the normal operating mode, an image signal V1 is inputted to the organic EL display device 10 from the exterior. The image signal correcting unit 27 carries out a correction process (described in detail later) on the image signal V1 and outputs a corrected image signal V2 to the display control circuit 12. The display control circuit 12 outputs a control signal CS1 to the scanning line driving circuit 13, and outputs a control signal CS2 to the data line driving circuit 14. In the normal operating mode, the display control circuit 12 outputs the corrected image signal V2 to the data line driving circuit 14.

The scanning line driving circuit 13 drives the scanning lines G1 to Gm on the basis of the control signal CS1. The data line driving circuit 14 drives the data lines S1 to Sn on the basis of the control signal CS2 and the corrected image signal V2. More specifically, the scanning line driving circuit 13 selects one of the scanning lines G1 to Gm in order and applies a high-level voltage to the selected scanning line for a single line period (a single horizontal period). The n pixel circuits 15 connected to the selected scanning line are selected as a result. The data line driving circuit 14 applies n voltages based on the corrected image signal V2 to the data lines S1 to Sn, respectively, for the single line period. n voltages are written to the selected n pixel circuits 15, respectively, as a result. The amount of current flowing in the transistor T1 changes depending on the voltage written to the pixel circuit 15 (a gate-source voltage of the transistor T1). The organic EL element L1 emits light at a brightness based on the current flowing in the transistor T1 and the organic EL element L1. The scanning line driving circuit 13 and the data line driving circuit 14 operate in tandem to write voltages to the (n×m) pixel circuits 15 within a single frame period. A desired image is displayed in a display screen of the organic EL display device 10 as a result.

The organic EL display device 10 transitions to the performance detecting mode when finding the initial performance of the organic EL elements L1 in an inspection process, when a user has instructed adjustment to be carried out for uneven brightness, when it has become time to adjust for uneven brightness, and the like. In the performance detecting mode, the organic EL display device 10 measures current flowing in the power source line 16 from all of the organic EL elements L1 included in the display unit 11 (called "panel current" hereinafter) when a predetermined image for inspection (called a "current measurement pattern" hereinafter) is displayed, and generates a current distribution pattern on the basis of the measured panel current. In the normal operating mode, the organic EL display device 10 corrects the image signal V1 on the basis of the current distribution pattern found in the performance detecting mode.

The current measurement pattern supplying unit 21 supplies k (where k is an integer greater than or equal to 2) current measurement patterns in order to the display control circuit 12. The current measurement pattern supplying unit 21 may store the k current measurement patterns in advance, or may generate the k current measurement patterns as needed. In the performance detecting mode, the display control circuit 12 outputs, to the data line driving circuit 14, the current measurement patterns supplied from the current measurement pattern supplying unit 21. In the performance detecting mode, the scanning line driving circuit 13 and the data line driving circuit 14 operate in the same manner as in the normal operating mode.

Figure 3:
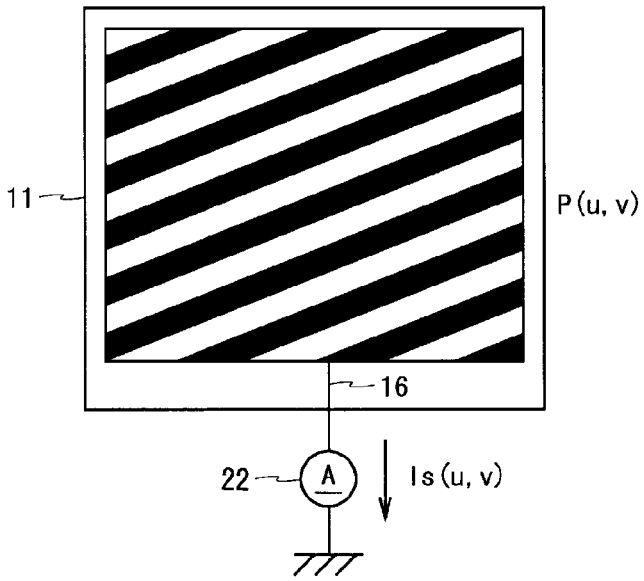
FIG. 3 is a diagram illustrating the measurement of panel current in the organic EL display device illustrated in FIG. 1.

FIG. 3 is a diagram illustrating the measurement of panel current. As illustrated in FIG. 3, the current measuring unit 22 is provided between the power source line 16 for supplying the low-level power source voltage ELVSS and a ground. The current measuring unit 22 measures the current flowing in the power source line 16 when the current measurement pattern is displayed using a single current measuring instrument. The panel current is measured through such a method.

The current measuring unit 22 measures the panel current k times, and outputs k panel current values in order. The current measurement value storage unit 23 stores the k panel current values outputted from the current measuring unit 22. The current distribution pattern generating unit 24 generates a current distribution pattern on the basis of the k panel current values stored in the current measurement value storage unit 23, and outputs the generated current distribution pattern to the correction parameter generating unit 26.

The image signal cumulating unit 25 cumulatively adds the image signal V1 on a pixel-by-pixel basis. The organic EL elements L1 degrade faster the greater the cumulative brightness is, and thus the greater the cumulation result, the more advanced the performance degradation of the organic EL element L1 is estimated to be. The correction parameter generating unit 26 generates correction parameters, used to correct the image signal V1, on the basis of the current distribution pattern outputted from the current distribution pattern generating unit 24 and the cumulation results found by the image signal cumulating unit 25. The image signal correcting unit 27 carries out the correction process on the image signal V1 using the generated correction parameters.

The current measurement patterns in the organic EL display device 10 will be described next. In the following descriptions, a gray scale minimum value is 0, a gray scale maximum value is MG, and a gamma coefficient of the organic EL display device is γ. The gamma coefficient is, for example, γ=2.2. Additionally, a spatial frequency in the horizontal direction of the display screen is represented by u, and a spatial frequency in the vertical direction is represented by v. N represents an integer greater than or equal to 1 and less than or equal to n/2, and M represents an integer greater than or equal to 1 and less than or equal to m/2.

The current measurement pattern supplied from the current measurement pattern supplying unit 21 is image data that as a whole changes in a sine wave shape or a cosine wave shape a predetermined number of times in the horizontal direction and the vertical direction. The k current measurement patterns include patterns P(u, v) and Q(u, v) for each set of u and v fulfilling −N≤u≤N and −M≤v≤M. The patterns P(u, v) and Q(u, v) each contain (n×m) pieces of data. The data Pu, v(x, y) at the yth row and xth column in the pattern P(u, v) is given by Equation (1) below. The data Qu, v(x, y) at the yth row and xth column in the pattern Q(u, v) is given by Equation (2) below. In Equation (1) and Equation (2), a=b=0.5.

[Equation 1]

$$P_{u,v}(x, y) = MG\left[a \cdot \sin\left\{2\pi\left(\frac{xu}{N} + \frac{yv}{M}\right)\right\} + b\right]^{1/\gamma} \tag{1}$$

$$Q_{u,v}(x, y) = MG\left[a \cdot \cos\left\{2\pi\left(\frac{xu}{N} + \frac{yv}{M}\right)\right\} + b\right]^{1/\gamma} \tag{2}$$

Figure 4:
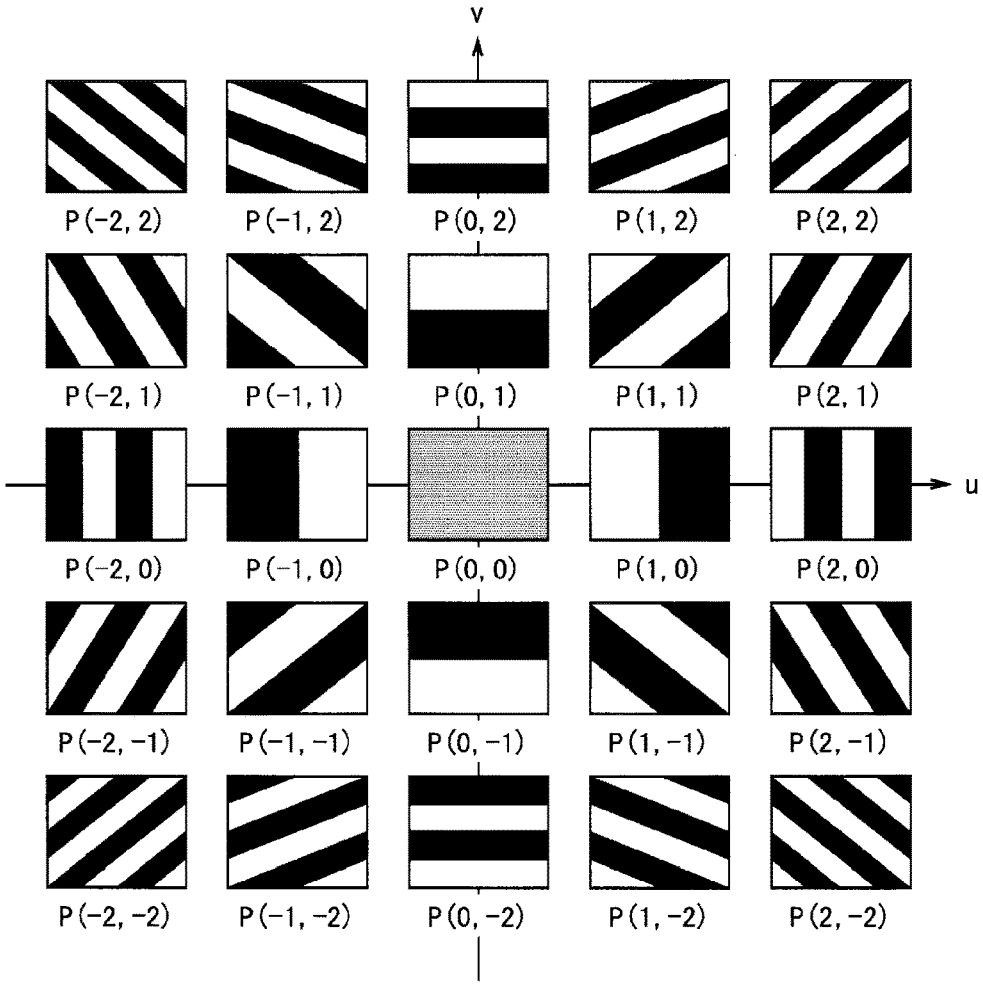
FIG. 4 is a diagram illustrating some current measurement patterns of the organic EL display device illustrated in FIG. 1.

FIG. 4 is a diagram illustrating some of the current measurement patterns. Patterns fulfilling −2≤u≤2 and −2≤v≤2 of the patterns P(u, v) are illustrated in FIG. 4. When a pattern P(0, 0) is displayed in the screen, ideally, all brightnesses in the display screen are ML/2 (where ML is the brightness maximum value). The pattern P(0, 0) is illustrated as an intermediate color to express this. When pattern P(1, 0) is displayed in the screen, the brightness of the display screen changes in sine wave shape once in the horizontal direction. The brightness in the left half of the display screen is greater than or equal to ML/2, whereas the brightness in the right half of the display screen is less than or equal to ML/2. The left half of the pattern P(1, 0) is illustrated as white and the right half of the pattern P(1, 0) is illustrated as black to express this. In the other patterns, too, the white parts indicate that the data is greater than or equal to MG/2, and the black parts indicate that the data is less than or equal to MG/2. The data at the boundary between the white parts and the black parts is MG/2.

The current distribution pattern is data indicating the extent to which the performance of the organic EL elements L1 has degraded. The current distribution pattern contains (n×m) pieces of data corresponding to the (n×m) pixel circuits 15. Data in the current distribution pattern corresponding to the pixel circuit 15 at the yth row and xth column will be referred to as I(x, y) hereinafter. A panel current Is(u, v) when the pattern P(u, v) is displayed in the screen is given by Equation (3) below. A panel current Ic(u, v) when the pattern Q(u, v) is displayed in the screen is given by Equation (4) below.

[Equation 2]

$$\begin{aligned} Is(u, v) &= \sum_{y=0}^{m-1}\sum_{x=0}^{n-1} I(x, y)\left[a \cdot \sin\left\{2\pi\left(\frac{xu}{N} + \frac{yv}{M}\right)\right\} + b\right] \\ &= a\sum_{y=0}^{m-1}\sum_{x=0}^{n-1} I(x, y)\sin\left\{2\pi\left(\frac{xu}{N} + \frac{yv}{M}\right)\right\} + b\sum_{y=0}^{m-1}\sum_{x=0}^{n-1} I(x, y) \\ &\triangleq a \cdot Is'(u, v) + b \cdot Is(0, 0) \end{aligned} \tag{3}$$

$$\begin{aligned} Ic(u, v) &= \sum_{y=0}^{m-1}\sum_{x=0}^{n-1} I(x, y)\left[a \cdot \cos\left\{2\pi\left(\frac{xu}{N} + \frac{yv}{M}\right)\right\} + b\right] \\ &= a\sum_{y=0}^{m-1}\sum_{x=0}^{n-1} I(x, y)\cos\left\{2\pi\left(\frac{xu}{N} + \frac{yv}{M}\right)\right\} + b\sum_{y=0}^{m-1}\sum_{x=0}^{n-1} I(x, y) \\ &\triangleq a \cdot Ic'(u, v) + b \cdot Is(0, 0) \end{aligned} \tag{4}$$

Equation (5) and Equation (6) below are derived from Equations (3) and (4). Equation (7) and Equation (8) below are derived by performing a two-dimensional inverse discrete Fourier transform on Equations (5) and (6). The data I(x, y) is given by Equation (9) below.

[Equation 3]

$$Is'(u, v) = \frac{Is(u, v) - b \cdot Is(0, 0)}{a} \tag{5}$$

$$Ic'(u, v) = \frac{Ic(u, v) - b \cdot Is(0, 0)}{a} \tag{6}$$

$$Is(x, y) = \frac{1}{N - M}\sum_{v=0}^{M-1}\sum_{u=0}^{N-1} Is'(u, v)\sin\left[2\pi\left(\frac{xu}{N} + \frac{yv}{M}\right)\right\} \tag{7}$$

$$Ic(x, y) = \frac{1}{N - M}\sum_{v=0}^{M-1}\sum_{u=0}^{N-1} Ic'(u, v)\cos\left[2\pi\left(\frac{xu}{N} + \frac{yv}{M}\right)\right\} \tag{8}$$

$$I(x, y) = Is(x, y) + Ic(x, y) \tag{9}$$

The current distribution pattern generating unit 24 generates the current distribution pattern containing the (n×m) pieces of the data I(x, y) by carrying out the operations indicated by Equations (5) to (9) on the k panel current values stored in the current measurement value storage unit 23. The generated current distribution pattern is supplied to the correction parameter generating unit 26.

The image signal cumulating unit 25 cumulatively adds the image signal V1 on a pixel-by-pixel basis while carrying out processing for preventing overflow in the cumulation results. For example, the image signal cumulating unit 25 may shift each cumulation result to the right by a predetermined number of bits every predetermined time period (multiplying by a power of 2), or may subtract half the maximum value of the cumulation results from each cumulation result every predetermined time period. Alternatively, the image signal cumulating unit 25 may subtract the minimum value of the cumulation results from each cumulation result every predetermined time period.

The correction parameter generating unit 26 generates the correction parameters on the basis of the current distribution pattern outputted from the current distribution pattern generating unit 24 and the cumulation results found by the image signal cumulating unit 25. The correction parameter generating unit 26 generates A(x, y) and B in Equation (10) (described later) as the correction parameters.

The image signal correcting unit 27 carries out the correction process on the image signal V1 according to Equation (10) below and outputs the corrected image signal V2.

[Equation 4]

$$Dout(x, y) = B\{Din(x, y) - Doffset\}\left\{A(x, y) \cdot \frac{Iinit}{I(x, y)}\right\}^{1/\gamma} + Doffset \quad (10)$$

In Equation (10), Din(x, y) is data in the yth row and xth column of the image signal V1. Dout(x, y) is data in the yth row and xth column of the corrected image signal V2. A(x, y) is a correction term related to the current and brightness in the case where the current is within a predetermined range, and is a correction coefficient pertaining to a light emission-current efficiency of each pixel. Doffset is a gray scale value serving as a reference when expanding the data range. B represents a gain set in correspondence with the gray scale range, and is a correction coefficient for adjusting the overall output gray scale range in correspondence with an input gray scale value. The gain B is adjusted so that the gray scale after correction is within a predetermined range. Iinit is an initial current value.

The organic EL display device 10 measures the panel current when the current measurement patterns are displayed, generates the current distribution pattern on the basis of the measured panel current, and corrects the image signal V1 on the basis of the generated current distribution pattern. Accordingly, the extent of performance degradation in the organic EL elements L1 can be estimated, and uneven brightness in the display screen can be prevented, without individually measuring the currents flowing in the organic EL elements L1.

As described thus far, the organic EL display device 10 according to the present embodiment includes: the display unit 11 including the plurality of scanning lines G1 to Gm, the plurality of data lines S1 to Sn, the power source line 16, and the plurality of pixel circuits 15, each of the plurality of pixel circuits 15 including an organic EL element L1; driving circuits (the scanning line driving circuit 13 and the data line driving circuit 14) configured to drive the plurality of scanning lines G1 to Gm and the plurality of data lines S1 to Sn; the current measuring unit 22 configured to measure current flowing in the power source line 16 from the plurality of organic EL elements L1; the current distribution pattern generating unit 24 configured to generate a current distribution pattern on the basis of a plurality of current values measured by the current measuring unit 22 in a case that a plurality of current measurement patterns that are predetermined are displayed in order; and the image signal correcting unit 27 configured to correct the image signal V1 on the basis of the current distribution pattern. The plurality of current measurement patterns are image data including parts that change periodically in the horizontal direction and the vertical direction. The current distribution pattern generating unit 24 is configured to generate the current distribution pattern by carrying out operations on the plurality of current values in accordance with periodic changes in the plurality of current measurement patterns.

With the organic EL display device 10 according to the present embodiment, the current distribution pattern indicating the extent of performance degradation in the organic EL elements L1 is generated by measuring the current flowing in the power source line 16 from the plurality of organic EL elements L1 when the current measurement patterns are displayed in order, and carrying out the operations on the plurality of current values. The image signal V1 is corrected using the generated current distribution pattern. Thus, according to the organic EL display device 10, the extent of performance degradation in the organic EL elements L1 can be estimated, and uneven brightness in the display screen can be prevented, without individually measuring the currents flowing in the organic EL elements L1.

Additionally, the plurality of current measurement patterns are image data including parts that change in sine wave shape or cosine wave shape in the horizontal direction and the vertical direction, and the current distribution pattern generating unit 24 is configured to generate the current distribution pattern by performing a two-dimensional inverse discrete Fourier transform on the plurality of current values. Accordingly, the above-described effects can be achieved by generating a current distribution pattern that expresses the extent of performance degradation in the organic EL elements well. Additionally, the plurality of current measurement patterns are image data that as a whole changes in sine wave shape or cosine wave shape in the horizontal direction and the vertical direction. The plurality of current measurement patterns include image data that as a whole changes in sine wave shape N or fewer times in the horizontal direction and M or fewer times in the vertical direction, and image data that as a whole changes in cosine wave shape N or fewer times in the horizontal direction and M or fewer times in the vertical direction, where N and M are integers greater than or equal to 1. Accordingly, the above-described effects can be achieved by using the plurality of current measurement patterns that as a whole change in sine wave shape or cosine wave shape in the horizontal direction and the vertical direction.

Additionally, the current measuring unit 22 is provided between the power source line 16 and a ground. Accordingly, the current flowing in the power source line 16 from the plurality of organic EL elements L1 can be measured using the current measuring unit 22. Additionally, the power source line 16 is connected to the cathode terminals of all of the organic EL elements L1 included in the display unit 11. Accordingly, the current flowing in the power source line 16 from all of the organic EL elements L1 included in the display unit 11 is measured using the current measuring unit 22. This makes it possible to prevent a drop in the accuracy of the current measurement caused by variations in the measurement accuracies of the current measuring instruments.

Additionally, the current measuring unit 22 is configured to measure current flowing in the power source line 16 from a cathode terminal common to the plurality of organic EL elements L1, and the image signal correcting unit 27 is configured to correct the image signal V1 on the basis of the current distribution pattern generated on the basis of the plurality of current values measured by the current measuring unit 22. Accordingly, the above-described effects can be achieved by measuring the current flowing in the power source line 16 from the cathode terminal common to the plurality of organic EL elements L1. Additionally, the current measuring unit 22 is configured to measure the current flowing in the power source line 16 from a cathode terminal common to all of the organic EL elements L1 included in the display unit 11. This makes it possible to prevent a drop in the accuracy of the current measurement caused by variations in the measurement accuracies of the current measuring instruments.

Additionally, the organic EL display device 10 includes the image signal cumulating unit 25 configured to find a cumulative added value of the image signal V1, and the image signal correcting unit 27 configured to correct the image signal V1 on the basis of the current distribution pattern and the cumulative added value. Correcting the image signal V1 taking into account the cumulative added value of the image signal V1 in this manner makes it possible to more effectively suppress uneven brightness in the display screen.

Many modifications can be made on the organic EL display device according to embodiments of the disclosure. An organic EL display device according to a modified example may include a pixel circuit aside from the pixel circuit 15 illustrated in FIG. 2. Additionally, the current measuring unit 22 is not limited to a unit including a single current measuring instrument, and may include a plurality of current measuring instruments.

Additionally, in an organic EL display device according to a modified example, the image signal correcting unit 27 may carry out the correction process in accordance with a calculation equation aside from Equation (10). When carrying out the correction process, the image signal correcting unit 27 may use the same calculation equation for the entire gray scale, or may use different calculation equations for each of ranges of the gray scale. The correction parameters may differ depending on the range of the gray scale. For example, the correction term A may be different for a high range of the gray scale and a low range of the gray scale. In a low range of the gray scale, the correction term A may include a correction value relating to dark fields.

Figure 5:
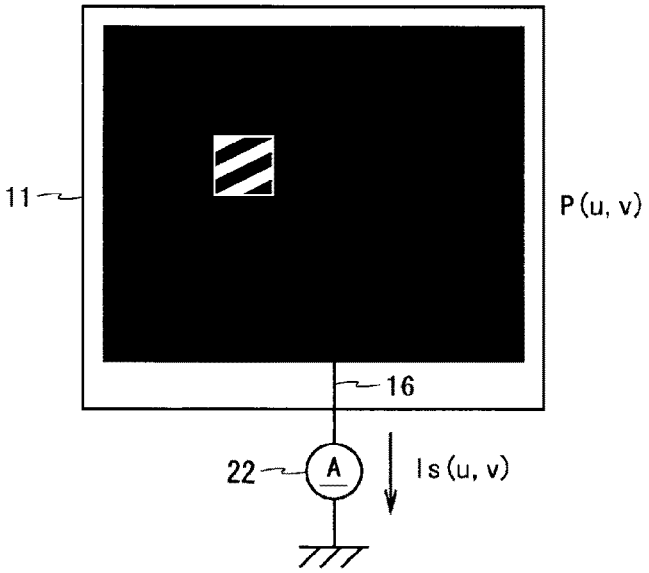
FIG. 5 is a diagram illustrating the measurement of panel current in the organic EL display device according to a modified example of the disclosure.

Additionally, an organic EL display device according to a modified example may divide the display unit 11 into a plurality of blocks, measure the current flowing in the power source line 16 from a plurality of organic EL elements L1 included in the pixel circuits 15 within a single block as the panel current, and then generate a current distribution pattern for each block (see FIG. 5). In this case, the current measurement patterns are image data in which parts change in sine wave shape or cosine wave shape in the horizontal direction and the vertical direction. The plurality of current measurement patterns include image data in which parts change in sine wave shape N or fewer times in the horizontal direction and M or fewer times in the vertical direction, and image data in which parts change in cosine wave shape N or fewer times in the horizontal direction and M or fewer times in the vertical direction, where N and M are integers greater than or equal to 1. The same effects as when using the current measurement patterns that as a whole change in sine wave shape or in cosine wave shape in the horizontal direction and the vertical direction can be achieved when using current measurement patterns in which parts change in sine wave shape or in cosine wave shape in the horizontal direction and the vertical direction. Additionally, the correction process can be carried out quickly by squaring the number of pixels in the horizontal direction and the number of pixels in the vertical direction of the blocks.

Additionally, in an organic EL display device according to a modified example, the current measurement patterns are not limited to image data having parts that change in sine wave shape or in cosine wave shape in the horizontal direction and the vertical direction, and may be image data having parts that change periodically in another periodic form in the horizontal direction and the vertical direction. In this case, the current distribution pattern generating unit generates the current distribution pattern by carrying out operations on the plurality of current values in accordance with the periodic changes in the current measurement patterns.

Additionally, in an organic EL display device according to a modified example, the pixel circuits 15 may be divided by display color. For example, in the case where the organic EL elements L1 emit red, green, or blue light, the pixel circuits 15 may be classified as red pixel circuits, green pixel circuits, and blue pixel circuits. In this case, the current measurement pattern supplying unit 21 may supply three types of current distribution patterns in accordance with the display colors, the current distribution pattern generating unit 24 may generate three types of current distribution patterns in accordance with the display colors, and the image signal correcting unit 27 may carry out the correction process using different computing equations in accordance with the display colors.

INDUSTRIAL APPLICABILITY

The organic electroluminescence display device and driving method thereof according to the disclosure can prevent uneven brightness in a display screen by estimating the extent of performance degradation in organic EL elements, and thus can be used in standalone display devices or in the display units of various types of electronic devices.

REFERENCE SIGNS LIST

10 Organic EL display device
11 Display unit
12 Display control circuit
13 Scanning line driving circuit
14 Data line driving circuit
15 Pixel circuit
16 Power source line
21 Current measurement pattern supplying unit
22 Current measuring unit
23 Current measurement value storage unit
24 Current distribution pattern generating unit
25 Image signal cumulating unit
26 Correction parameter generating unit
27 Image signal correcting unit

The invention claimed is:

1. An organic electroluminescence display device comprising, a display unit including a plurality of scanning lines, a plurality of data lines, a power source line, and a plurality of pixel circuits, each of the plurality of pixel circuits including an organic electroluminescence element;

a driving circuit configured to drive the plurality of scanning lines and the plurality of data lines;

a current measuring unit configured to measure current flowing in the power source line from a plurality of the organic electroluminescence elements;

a current distribution pattern generating unit configured to generate a current distribution pattern, based on a plurality of current values measured by the current measuring unit in a case that a plurality of current measurement patterns that are predetermined are displayed in order; and an image signal correcting unit configured to correct an image signal, based on the current distribution pattern, wherein the plurality of current measurement patterns are image data, the image data including parts that change periodically in a horizontal direction and a vertical direction;

the current distribution pattern generating unit is configured to generate the current distribution pattern by carrying out operations on the plurality of current values in accordance with periodic changes in the plurality of current measurement patterns;

the plurality of current measurement patterns are image data, the image data including parts that change in sine wave shape or cosine wave shape in the horizontal direction and the vertical direction; and the current distribution pattern generating unit is configured to generate the current distribution pattern by performing a two-dimensional inverse discrete Fourier transform on the plurality of current values.

2. The organic electroluminescence display device according to claim 1, wherein the plurality of current measurement patterns are image data, the image data as a whole changing in sine wave shape or cosine wave shape in the horizontal direction and the vertical direction.

3. The organic electroluminescence display device according to claim 2, wherein the plurality of current measurement patterns include image data that as a whole changes in sine wave shape N or fewer times in the horizontal direction and M or fewer times in the vertical direction, and image data that as a whole changes in cosine wave shape N or fewer times in the horizontal direction and M or fewer times in the vertical direction, where N and M are integers greater than or equal to 1.

4. The organic electroluminescence display device according to claim 1, wherein the plurality of current measurement patterns are image data, parts of the image data changing in sine wave shape or cosine wave shape in the horizontal direction and the vertical direction.

5. The organic electroluminescence display device according to claim 4, wherein the plurality of current measurement patterns include image data in which parts change in sine wave shape N or fewer times in the horizontal direction and M or fewer times in the vertical direction, and image data in which parts change in cosine wave shape N or fewer times in the horizontal direction and M or fewer times in the vertical direction, where N and M are integers greater than or equal to 1.

6. The organic electroluminescence display device according to claim 1, wherein the current measuring unit is provided between the power source line and a ground.

7. The organic electroluminescence display device according to claim 6, wherein the power source line is connected to a cathode terminal of all of the organic electroluminescence elements included in the display unit.

8. The organic electroluminescence display device according to claim 1, wherein the current measuring unit is configured to measure current flowing in the power source line from a cathode terminal common to a plurality of the organic electroluminescence elements; and the image signal correcting unit is configured to correct the image signal, based on a current distribution pattern generated, based on a plurality of current values measured by the current measuring unit.

9. The organic electroluminescence display device according to claim 8, wherein the current measuring unit is configured to measure current flowing in the power source line from a cathode terminal common to all of the organic electroluminescence elements included in the display unit.

* * * * *